US011484081B2

(12) United States Patent
Baylor et al.

(10) Patent No.: US 11,484,081 B2
(45) Date of Patent: Nov. 1, 2022

(54) HEAD COVERING AND METHOD

(71) Applicants: Jessie Ricardo Baylor, Ponchatoula, LA (US); Tanya Delores Baylor, Ponchatoula, LA (US)

(72) Inventors: Jessie Ricardo Baylor, Ponchatoula, LA (US); Tanya Delores Baylor, Ponchatoula, LA (US)

( * ) Notice: Subject to any disclaimer, the term of this patent is extended or adjusted under 35 U.S.C. 154(b) by 0 days.

(21) Appl. No.: 16/987,373

(22) Filed: Aug. 6, 2020

(65) Prior Publication Data

US 2021/0204630 A1 Jul. 8, 2021

Related U.S. Application Data

(60) Provisional application No. 62/958,129, filed on Jan. 7, 2020.

(51) Int. Cl.
*A42B 1/041* (2021.01)
*A42B 1/22* (2006.01)

(52) U.S. Cl.
CPC ..... *A42B 1/041* (2013.01); *A42B 1/22* (2013.01)

(58) Field of Classification Search
CPC ..... A42B 1/041; A42B 1/22; A42B 1/049; A42B 1/04; A42B 1/06; A42B 1/012; A42B 1/206; A42B 7/00; A42B 1/201; A45D 8/40; A61F 13/12; A41D 23/00; A41D 27/08
USPC ..... 2/203; 602/74, 61
See application file for complete search history.

(56) References Cited

U.S. PATENT DOCUMENTS 160,452 A * 3/1875 Mendel ..... A42B 1/0186 2/172
1,443,475 A * 1/1923 Karus ..... A42B 1/0186 2/172
1,516,796 A * 11/1924 Seilaz ..... A45D 8/40 132/274
1,720,560 A * 7/1929 Lipper ..... A42B 1/041 2/195.8
1,749,340 A * 3/1930 Grean ..... A42B 1/041 2/195.7
1,857,574 A * 5/1932 Sykora ..... A42B 1/22 2/195.4
2,039,478 A * 5/1936 Ensten ..... A42B 1/045 2/205
2,119,330 A * 5/1938 Hirsh ..... A42B 1/041 2/209.3
2,678,449 A * 5/1954 Turscak ..... A41D 23/00 2/203
5,161,260 A * 11/1992 Reynolds ..... A42B 1/0186 2/207
5,594,956 A * 1/1997 Barrientos ..... A42B 1/041 2/171

(Continued)

FOREIGN PATENT DOCUMENTS

DE 570884 C * 2/1933
FR 698745 A * 2/1931
FR 717985 A * 1/1932

*Primary Examiner* — Amy Vanatta
(74) *Attorney, Agent, or Firm* — Brett A. Schenck

(57) ABSTRACT

A durag is provided. The durag is configured to configured to cover a head of a user. The durag includes a tail. The tail is attached to a peripheral end of the center cap portion. The tail includes a first portion and a second portion. The tail is wrapped around the head of the user and the first portion is detachably attached to the second portion.

20 Claims, 10 Drawing Sheets

(56) References Cited

U.S. PATENT DOCUMENTS

| | | | | | |
|---|---|---|---|---|---|
| 5,906,006 | A * | 5/1999 | Castro, Jr. | A42B 1/041 | 2/207 |
| D458,004 | S * | 6/2002 | Magdziak-Hautala | A45D 8/40 | D2/500 |
| 6,738,986 | B1 * | 5/2004 | Martin | A42B 1/041 | 2/207 |
| 7,591,025 | B2 * | 9/2009 | McGhee | A42B 1/041 | 2/202 |
| D645,646 | S * | 9/2011 | Fuglsang | A42B 1/06 | D2/880 |
| 2002/0104150 | A1 * | 8/2002 | Hill | A42B 1/041 | 2/174 |
| 2009/0000011 | A1 * | 1/2009 | Halley | A42B 5/00 | 2/207 |
| 2011/0247126 | A1 * | 10/2011 | White | A42B 1/041 | 2/207 |
| 2017/0311692 | A1 * | 11/2017 | Morgan | A42B 1/041 | |
| 2019/0037944 | A1 * | 2/2019 | Tussey | A42B 1/041 | |
| 2019/0289947 | A1 * | 9/2019 | Baylor | A42B 1/049 | |
| 2019/0297980 | A1 * | 10/2019 | Celaya | A42B 1/06 | |

* cited by examiner

HEAD COVERING AND METHOD

FIELD

This application relates to a head covering and method.

BACKGROUND

A durag (also spelled as doo-rag, dew-rag, or du-rag), is a type of head covering. Durags are regularly used to create and maintain waves and cornrowed hairstyles. Such hairwaves are a popular hairstyle that includes curls that have been laid down. The hair is cropped short to the head in the styling of a caesar cut. After that is done, brushing techniques are then applied to produce an effect reminiscent of "oceanic waves". Hairwaves can be maintained through frequent and adequate brushing of the hair and the use of a durag. A durag may also be used to hold chemically processed hair-do or hair styles of a user in place, especially whiles the user sleeps. Durags are good for use on natural and chemically processed hair, and help chemically processed hair. Durags usually have long tails on either side that are wrapped around the head to secure the durag by tying them at the back of the head. Durags may also be tied at the front of the head. Tying the tails may be cumbersome to do.

Durags may be made of nylon material or a polyester material. When washing the hair, one has to remove the durag, wash and rinse the hair, and then put the durag back on. This can be cumbersome and time consuming. Also, the rinsing may cause the waves to deteriorate and lose their form.

Durags may benefit from improvements.

SUMMARY

A durag is provided. The durag is configured to configured to cover a head of a user. The durag includes a tail. The tail is attached to a peripheral end of the center cap portion. The tail includes a first portion and a second portion. The tail is wrapped around the head of the user and the first portion is detachably attached to the second portion.

Other aspects of the disclosed invention will become apparent from the following detailed description, the accompanying drawings and the appended claims.

DETAILED DESCRIPTION

It will be readily understood that the components of the embodiments as generally described and illustrated in the figures herein, may be arranged and designed in a wide variety of different configurations in addition to the described example embodiments. Thus, the following more detailed description of the example embodiments, as represented in the figures, is not intended to limit the scope of the embodiments, as claimed, but is merely representative of example embodiments.

Furthermore, the described features, structures, or characteristics may be combined in any suitable manner in one or more embodiments. In the following description, numerous specific details are provided to give a thorough understanding of embodiments. One skilled in the relevant art will recognize, however, that the various embodiments can be practiced without one or more of the specific details, or with other methods, components, materials, etc. In other instances, well-known structures, materials, or operations are not shown or described in detail to avoid obfuscation. The following description is intended only by way of example, and simply illustrates certain example embodiments.

Figure 6:
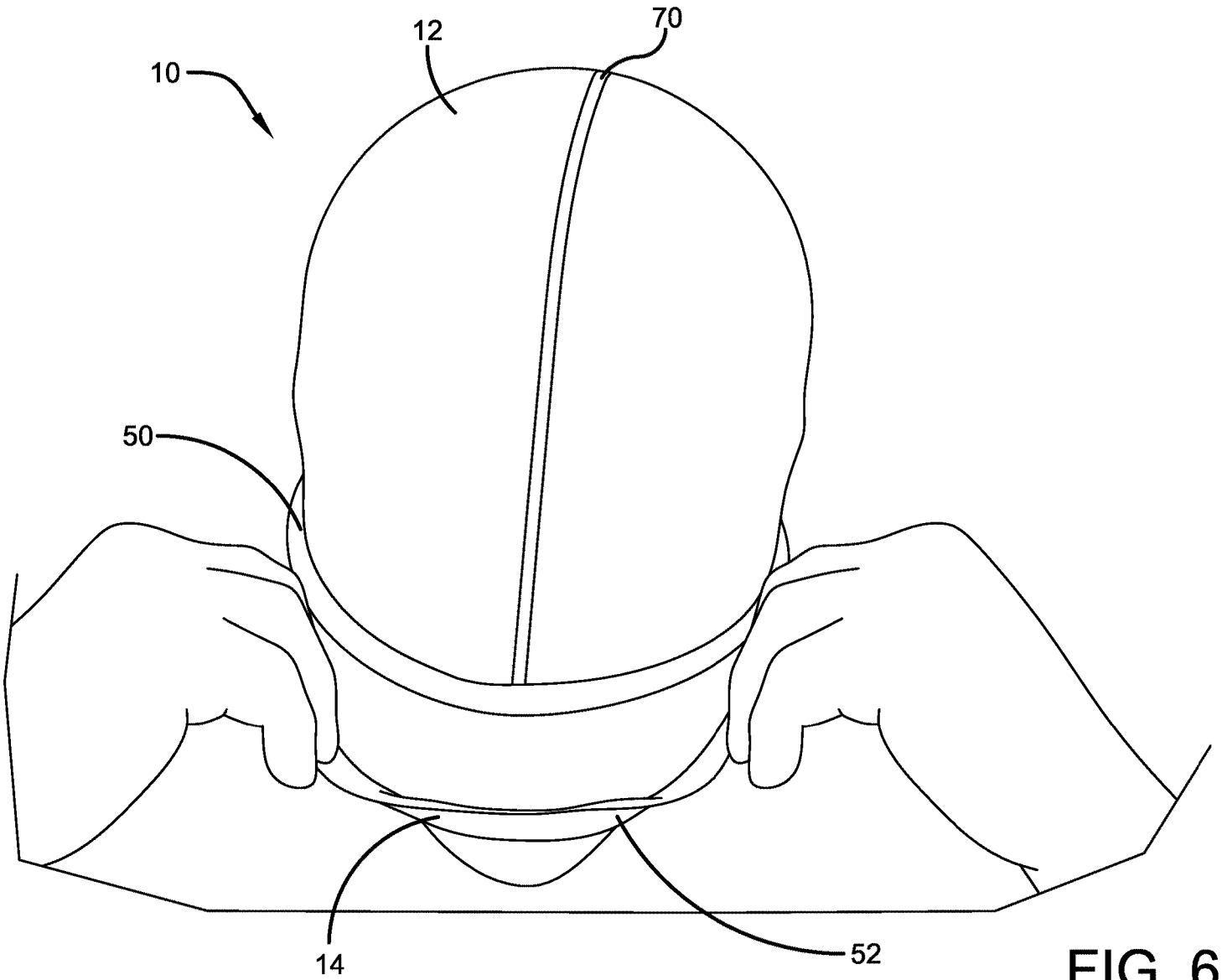
FIG. 6 is a top and front perspective view of the durag of FIG. 1 with the center cap portion being placed on the head of a user.

Throughout the present description, the terms "upper", "lower", "top", "bottom", "left", "right", "front", "forward", "rear", and "rearward" shall define directions or orientations with respect to the durag as illustrated in FIG. 6. It will be understood that the spatially relative terms "upper", "lower", "top", "bottom", "left", "right", "front", "forward", "rear", and "rearward" are intended to encompass different orientations of the durag in use or operation in addition to the orientation depicted in the figures. For example, if the durag in the figures is turned over, elements described as "upper" elements or features would then be "lower" elements or features.

Figure 1:
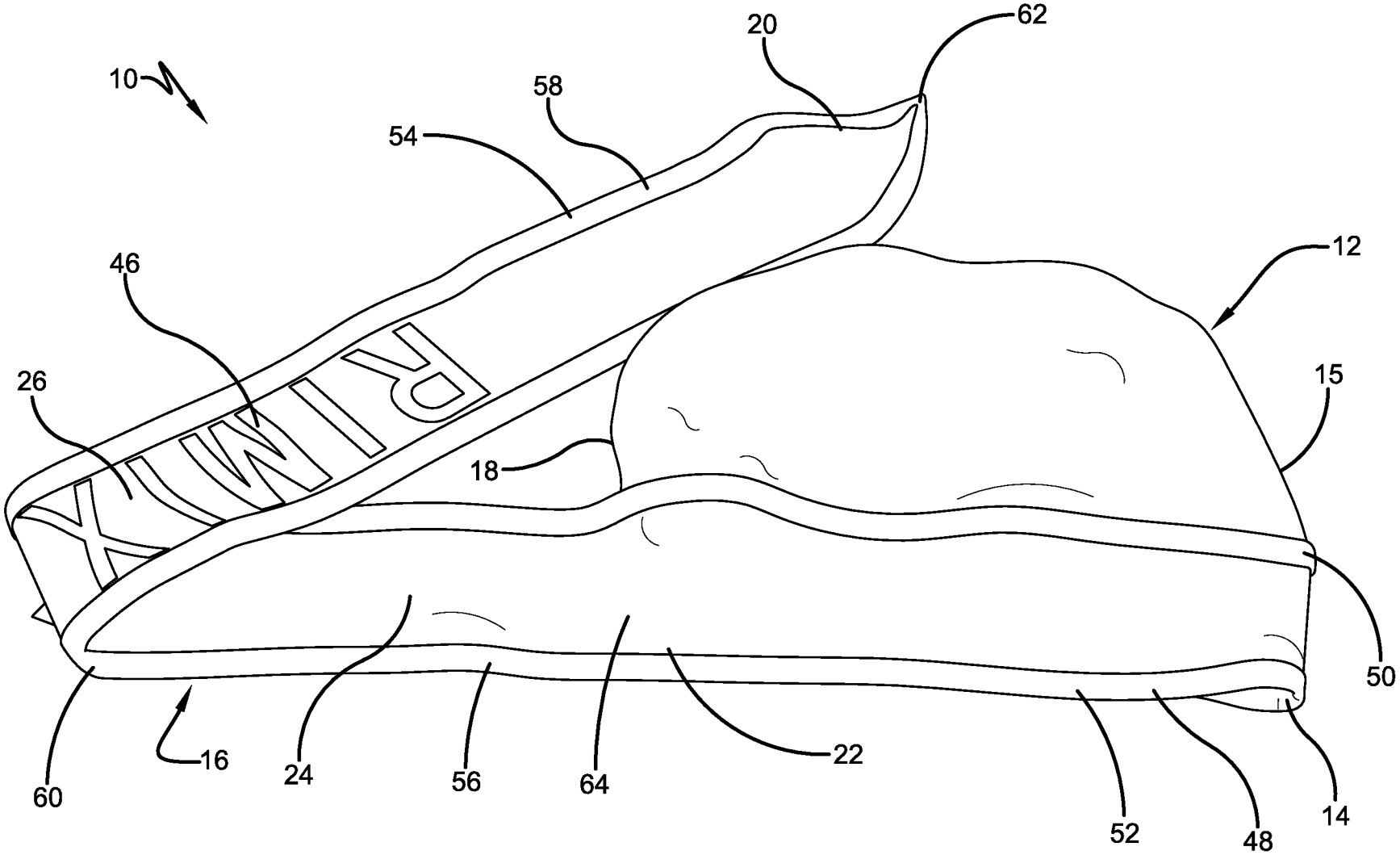
FIG. 1 is a left side perspective view of the durag with the tail folded according to an embodiment of the invention.

Referring to FIG. 1, a durag 10 is shown. The durag 10 includes a hemispherical shaped center cap portion 12 that covers the entire surface of a head of a user. When placed on a user's head as shown in FIGS. 6-10, the center cap portion 12 extends from the front of the user's head to the nape of the neck in the back of the head. The center cap portion 12 includes a cap peripheral end 14. The durag 10 further comprises a wrap or tail 16 that is attached to the cap peripheral end 14 at the rear end 18 of the center cap portion 12. The length of the tail 16 is more than twice the length of the center cap portion 12. The tail 16 includes a tail peripheral end 20 that merges with the cap peripheral end 14 to define the peripheral end 22 of the durag 10.

Figure 2:
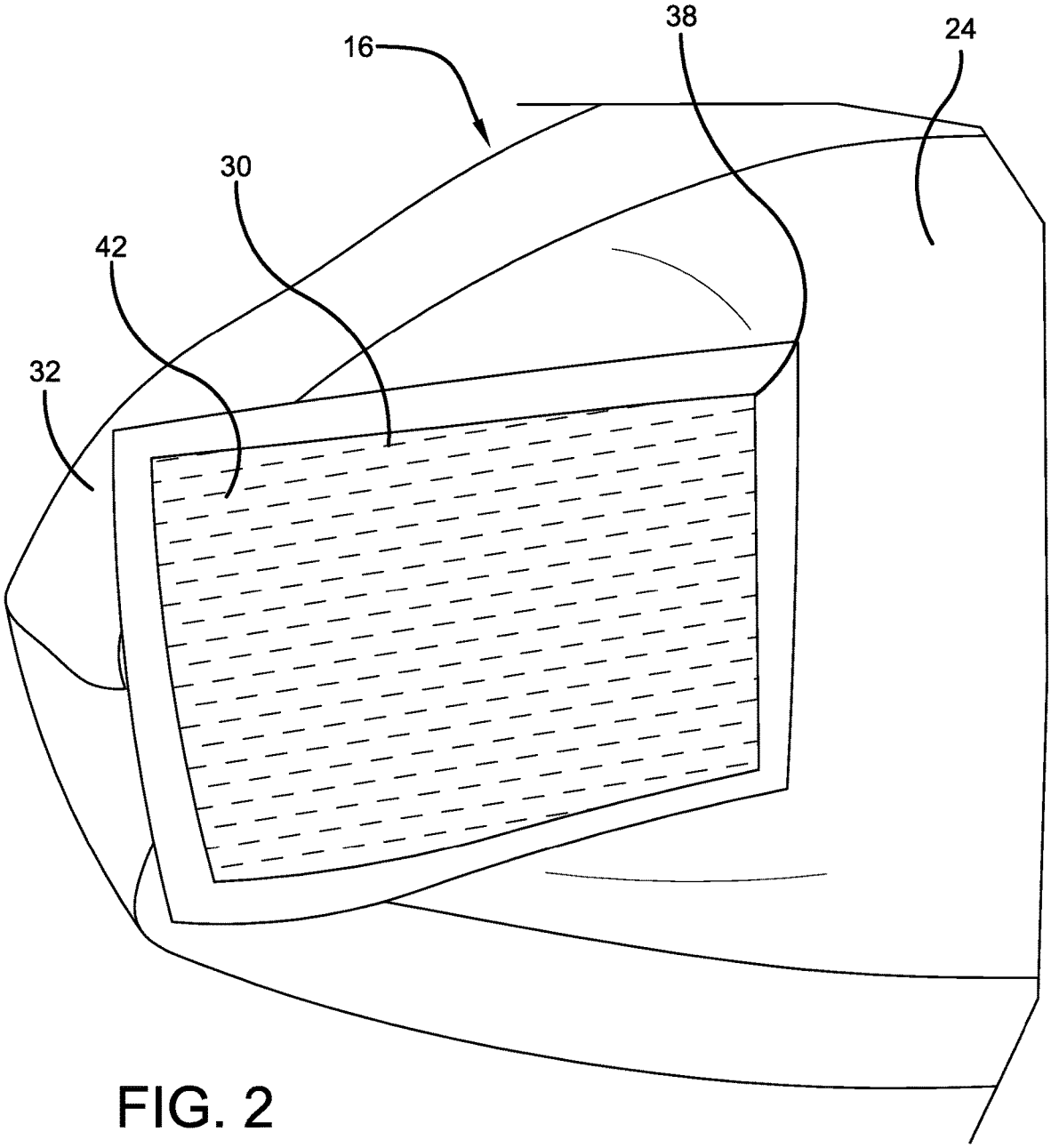
FIG. 2 is a side view of a portion of the tail of the durag of FIG. 1 that shows the first fabric strip of the hook and pile fastener.
Figure 3:
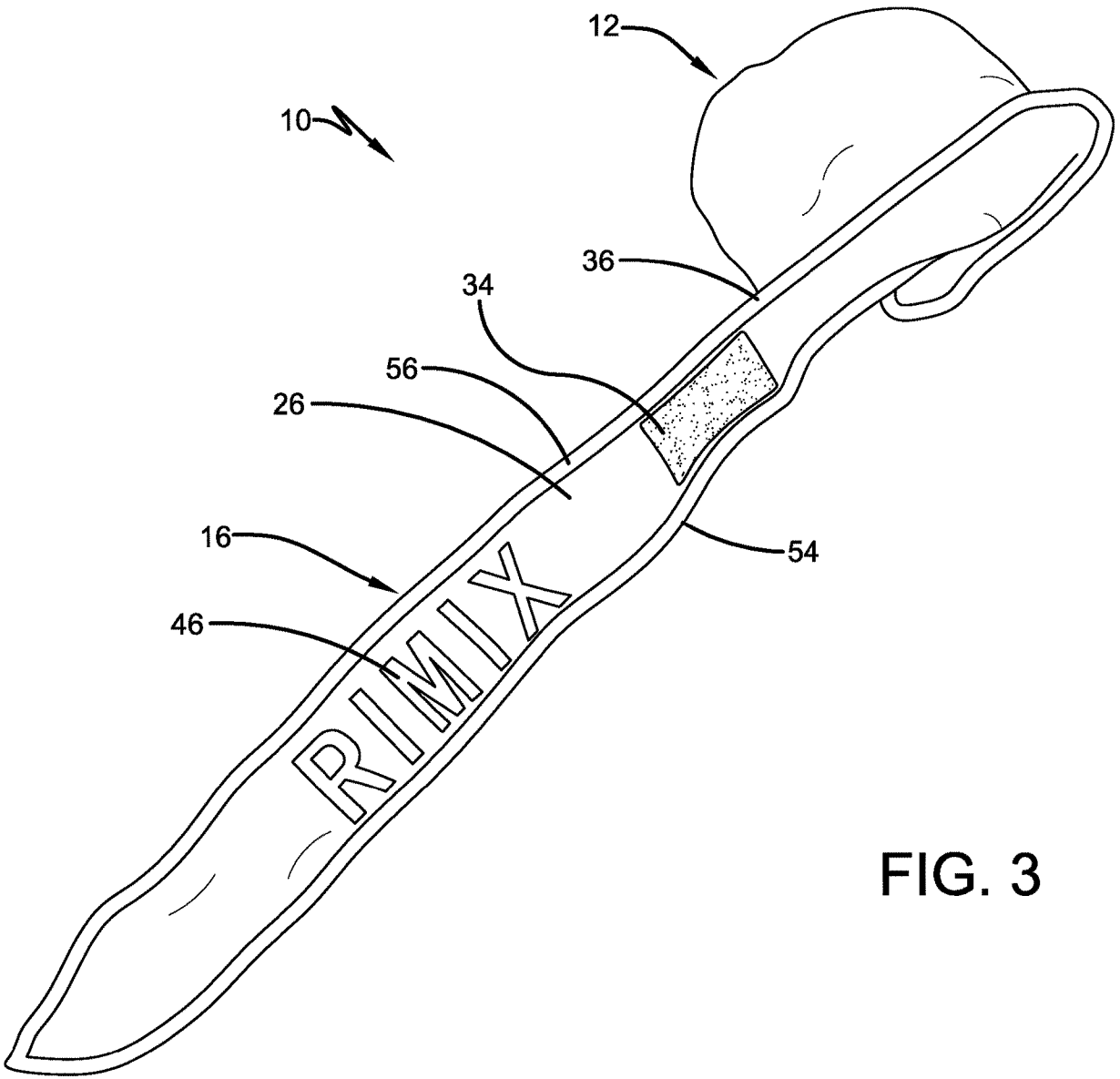
FIG. 3 is a left side perspective view of the durag of FIG. 1 with the cap peripheral end folded up and the tail flipped over.
Figure 4:
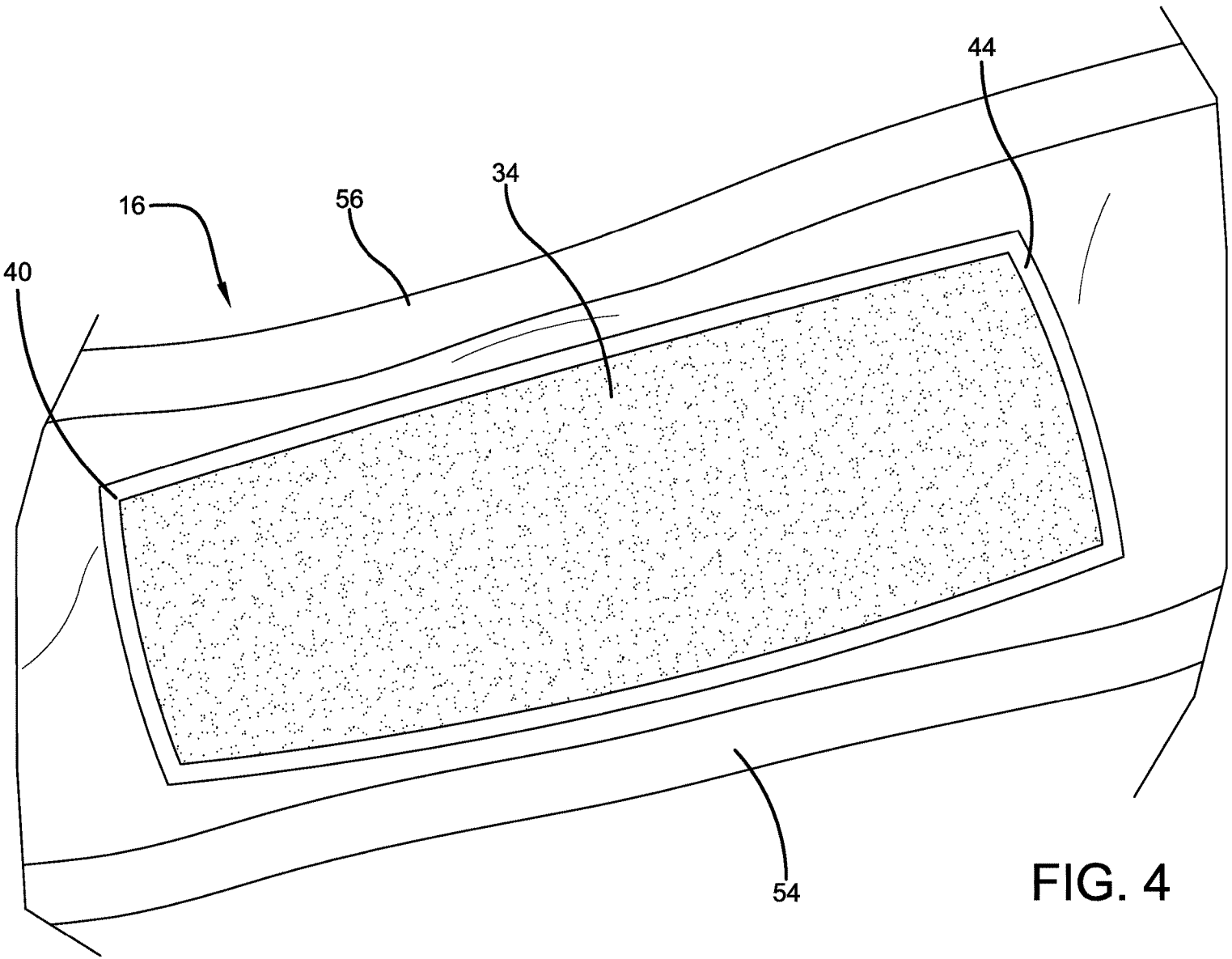
FIG. 4 is a side view of a portion of the tail of the durag of FIG. 1 that shows the second fabric strip of the hook and pile fastener.
Figure 10:
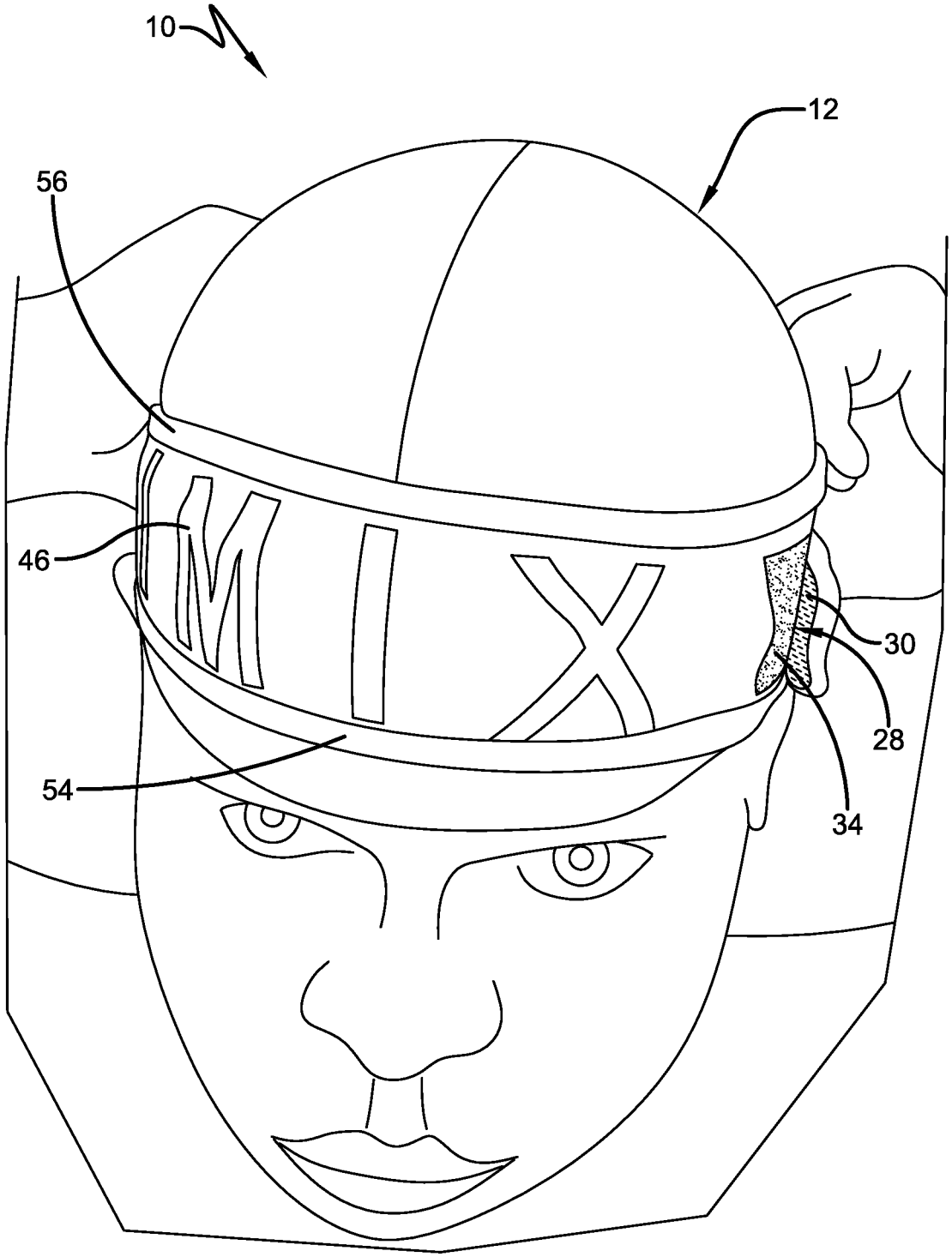
FIG. 10 is a front perspective view of the durag worn on the user such that the tail is wrapped around the head of the user and fastened to itself.

The tail 16 has an interior facing side 24 (FIG. 1) that faces the head of the user when the durag 10 is worn on the user and an exterior facing side 26 (FIGS. 1 and 3) that faces away from the head of the user when the durag 10 is worn on the user as seen in FIG. 10. Referring to FIGS. 2-4 and 10, the tail 16 includes a hook and pile fastener 28 (FIG. 16) such as Velcro® thereon to detachably attach the tail 16 to itself to provide a snug fit when the tail 16 is wrap snugly around the head of the user. In particular, a first lineal fabric strip 30 comprising small hooks is sewn or otherwise adhered to the interior facing side 24 of the tail 16 near a distal end 32 of the tail 16 as seen in FIG. 2. A second lineal fabric strip 34 comprising smaller loops is sewn or otherwise adhered to the exterior facing side 26 of the tail near a proximal end 36 of the tail 16 as seen in FIGS. 3 and 4. When the strips 30, 34 are pressed together, the hooks catch in the loops and the strips 30, 34 fasten or bind temporarily together.

The second lineal fabric strip 34 extends longitudinally along the tail at about one fourth of the length of the tail. For example, the tail may be 20 inches long and the length of the second lineal fabric strip may be 5 inches. The tail 16 may be wrapped around the head of the user and the first and second fabric strips 30, 34 may be attached to each other at selective areas along their lengths. This allows the durag 10 to fit various head sizes as well as enable the user to tighten or loosen the fit of the durag 10 on the user. For example, the area near a trailing end 38 of first fabric strip 30 may attached near a leading end 40 of the second fabric strip 34 to accommodate fitting a small head size, and the area near a leading end 42 of first fabric strip 30 may attached near a trailing end 44 of the second fabric strip 34 to accommodate fitting a large head size. When the strips 30, 34 are pressed together, the hooks catch in the loops and the two fabric strips 30, 34 fasten or bind temporarily together. Indicia 46 (FIG. 3) may be printed or otherwise provided on the exterior facing side 26 of the tail 16. The durag 10 may include only the one tail described above. Alternatively, the durag may include more than one tail.

Figure 5:
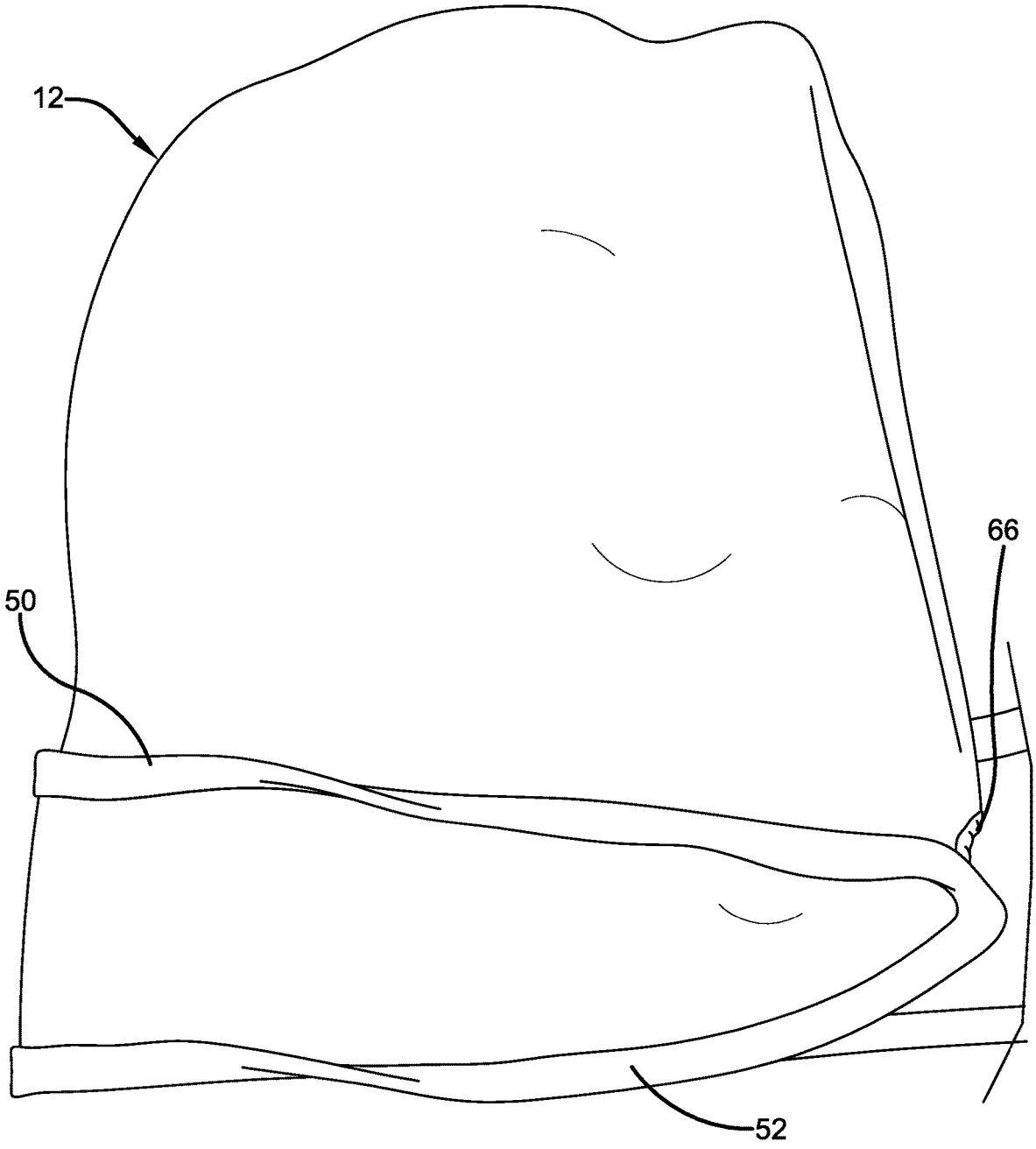
FIG. 5 is a right side view of a portion of the durag showing the center cap portion.

A fabric strip or trim 48 (FIG. 1) is stitched to the durag 10 and extends along most of the peripheral end 22 of the durag 10. At the center cap portion 12, the trim 48 comprises a proximal portion 50 and distal portion 52 relative to the center cap portion 12. The distal portion 52 is stitched along a substantial portion of the cap peripheral end 14 and extends almost around the center cap portion 12. The proximal portion 50 extends almost around the center of the center cap portion 12 and is spaced radially inwardly from the distal portion 52. The proximal portion 50 is stitched on the outer side of the cap and does not extend under the center cap portion 12. The proximal and distal portions 50, 52 merge or come together at the rear end 18 of the center cap portion 12 as seen in FIG. 5. The proximal portion 50 and the distal portion 52 are radially spaced from each other such that a portion of the center cap portion 12 is located between the proximal portion 50 and the distal portion 52 except at the location where they merge together.

At the tail 16, the trim 48 includes third and fourth portions 54, 56 located on opposite longitudinal ends 58, 60, respectively, of the tail and merge or come together at the distal end 62 of the tail. The third portion 54 merges with the proximal portion 50 and the fourth portion 56 merges with the distal portion 52 of the trim 48. The distal portion 52 and third and fourth portions 54, 56 may formed by hemming the peripheral end 22 of the durag 10. The trim 48 may be of a different color than the remaining portion of the durag 10. For example, the trim 48 and indicia 46 may be of white color and the remaining portion 64 of the durag 10 may be black. Other example color combinations may comprise a gold trim and indicia and a black remaining portion, a red trim and indicia and a black remaining portion, a blue trim and indicia and a black remaining portion. There may be more different color combinations. Alternatively, the trim and the remaining portion may be the same color such as all black, all red, all blue, or all white.

An elastic rear band 66 (FIGS. 5 and 8) extends between the location where the proximal and distal portions 50, 52 of the trim 48 merge and the location where the proximal portion and the third portion 54 merge. When durag 10 is worn on the head of a user, the proximal and distal portions 50, 52 of the trim 48 extend almost around the head of the user. A tag 68 may be stitched to the elastic band 66. The durag 10 may also be worn over another durag on the head of the user. A seam 70 (FIG. 6) is sewn or stitched in the center of the center cap portion 12 and extends from the proximal portion of the trim 48 at the front end 15 of the durag 10 and goes straight through the center of the center cap portion to the band 66 at the rear end 18 of the durag 10. The seam 70 provides additional strength to the center cap portion 12.

The durag 10 is made of a thick fabric material. The durag 10 may include an elastic material that enables the durag 10 to stretch. The material may be polyester or lycra. The durag 10 may be configured to be sufficiently porous such that water from a standard shower head may flow through the center cap portion 12 of the durag 10 to rinse all or most of the shampoo out of the hair of a user yet still allow a fast recovery of the waves created in the hair of the user.

In another embodiment, the durag 10 may also have a two toned color design in which one of the hemispheres of the central cap portion 12 and one color and the other hemisphere of the central cap portion 12 is a different color. The durag 10 may also alternatively be made of silk.

Figure 7:
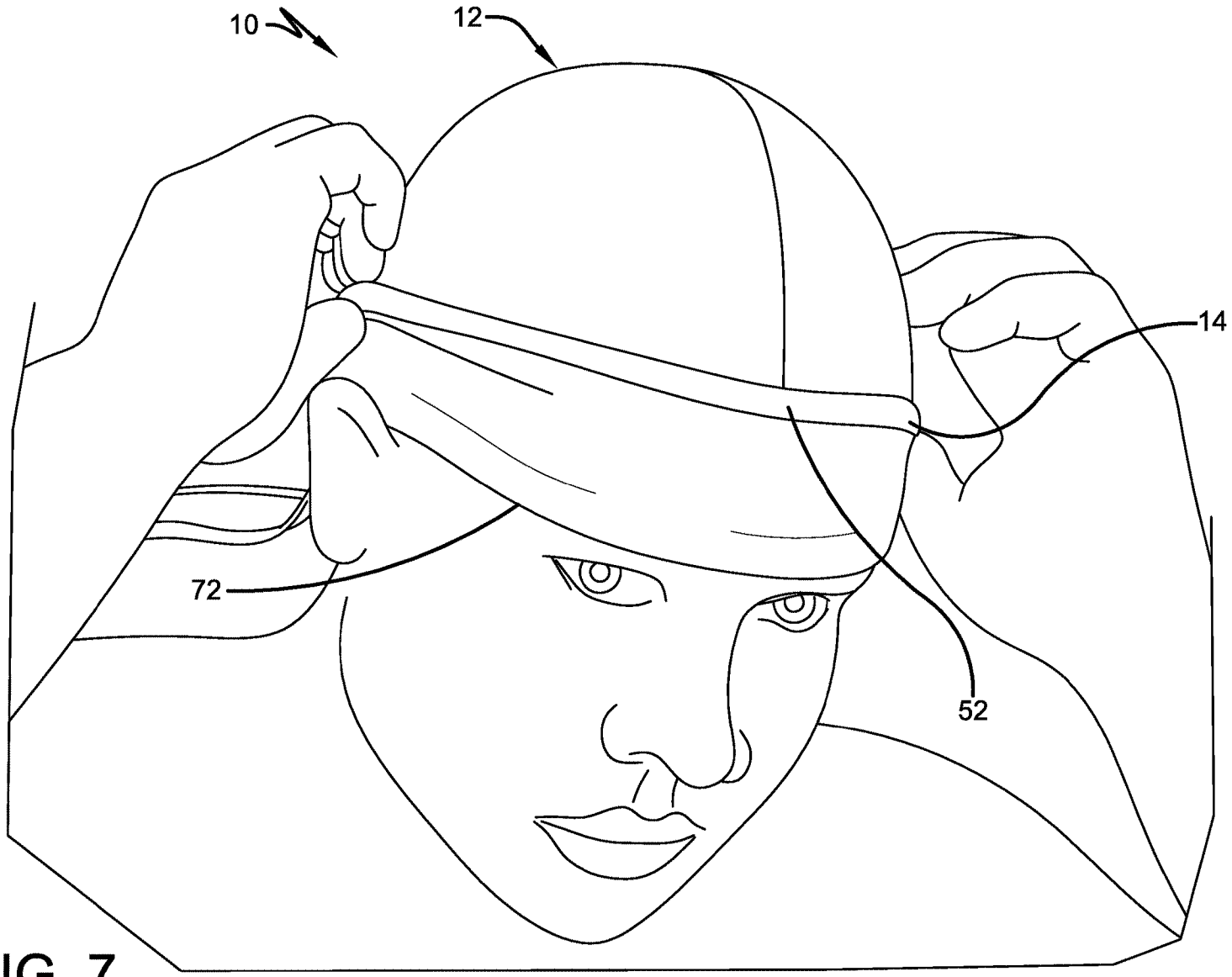
FIG. 7 is a front and left side perspective view of the durag with the center cap portion being placed on the head of the user and the cap peripheral end folded up.
Figure 8:
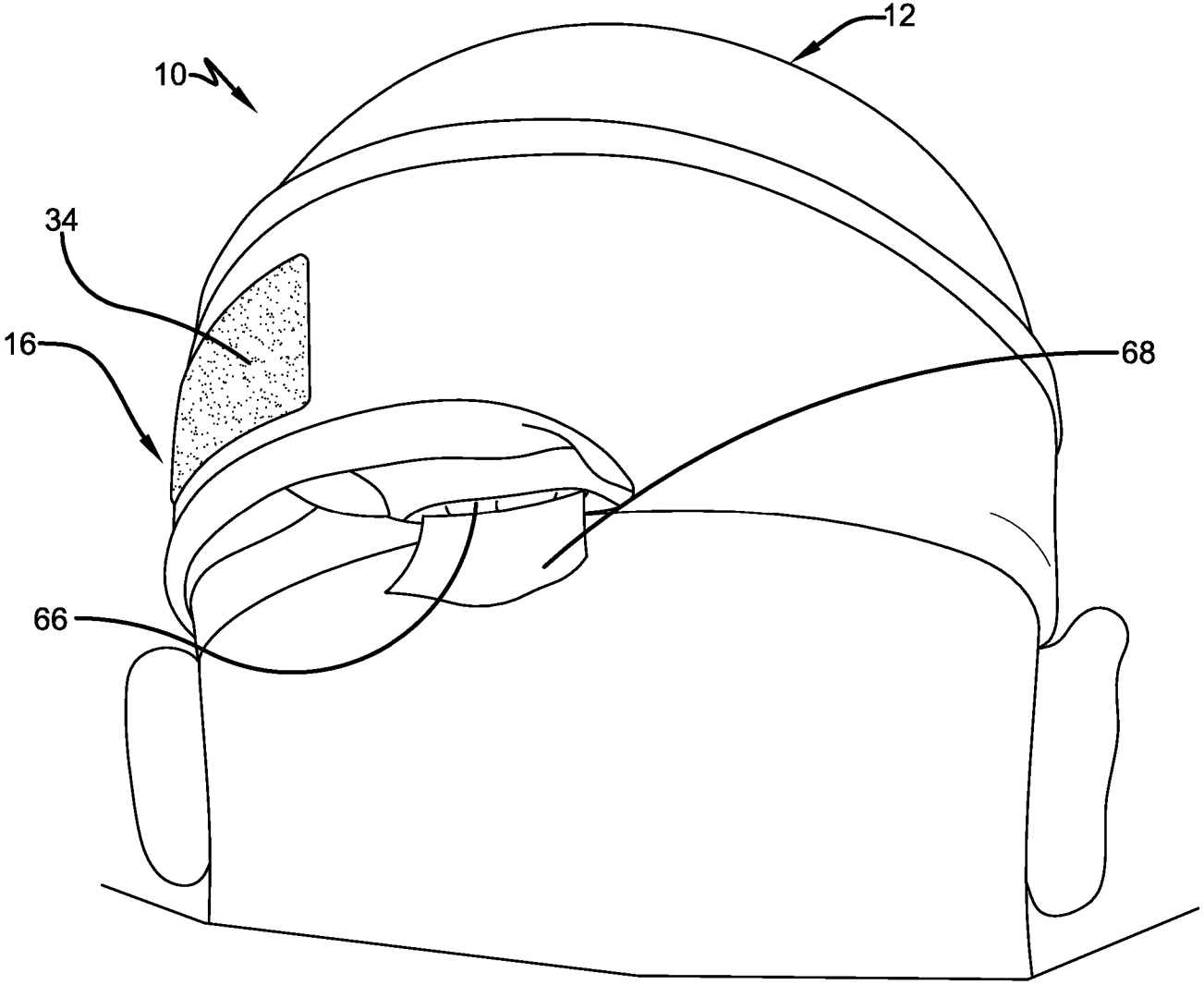
FIG. 8 is a rear perspective view of the durag with the center cap portion being placed on the head of the user with the cap peripheral end folded up and the tail flipped over and a portion of the tail placed on the center cap portion.
Figure 9:
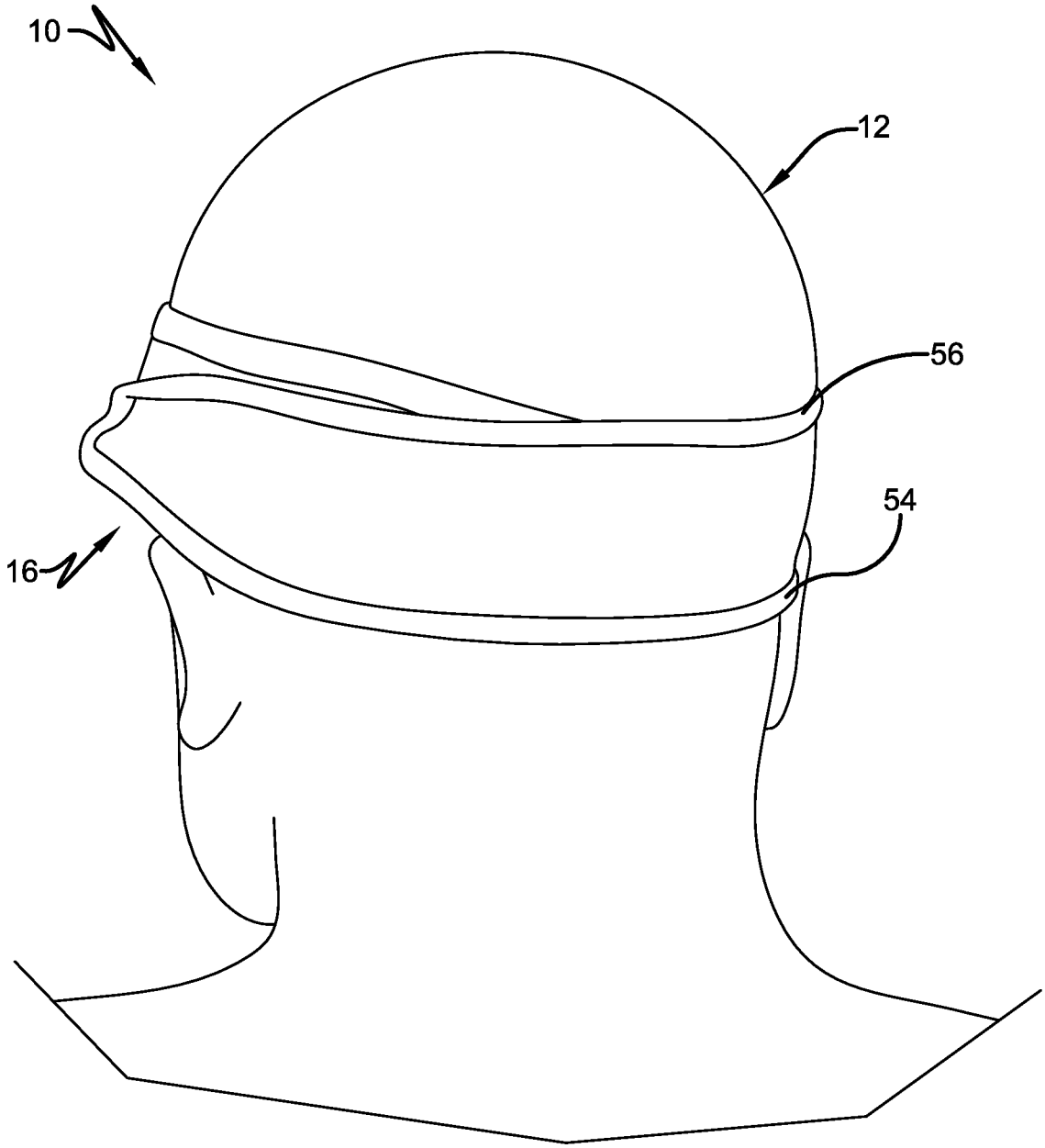
FIG. 9 is rear and right perspective view of the durag worn on the user such that the tail is wrapped around the head of the user and fastened to itself.

Referring to FIGS. 6 to 10, The durag 10 is fitted and worn on the head of the user as follows. First, the center cap portion 12 is placed on the user's head as seen in FIG. 6. The cap peripheral end 14 is then folded up. The folding line 72 may be at or near the lower edge of the proximal portion 50 of the trim 48 such that when the cap peripheral end 14 is folded up, the distal portion 52 of the trim 48 is higher than the proximal portion 50 of the trim 48 as seen in FIG. 7. This folding action also flips the tail 16 over such that the fourth portion 56 of the trim 48 at the tail 16 is now located higher (relative to the head of the user) than the third portion 54 of the trim 48 and the indicia 46 and first fabric strip 30 are visible and facing away from the users head as seen in FIGS. 8-10. The tail 16 is then wrapped around the head of the user and the fabric strips 30, 34 are pressed together such that the hooks catch in the loops and the strips fasten or bind temporarily together to snugly fit the durag 10 on the user. The tail 16 may cover the portion of the center cap portion 12 between the proximal and distal portions 50, 52 of the trim and optionally the proximal and distal portions 50,52 themselves. The first and second fabric strips 30, 34 are generally located on the right side of the head of the user as shown in FIGS. 8-10. The indicia 46 is also not upside down when the tail is flipped over (in this folding action) and wrapped around the head of the user with the strips fastened together.

The durag may protect hair wave patterns of 180, 360, 540, and 720 on a user's hair when worn. The durag material is comfortable and includes a breathable texture that can help keep the hair compressed during the night while retaining significant moisture on the hair.

Although various embodiments of the disclosed head covering and method have been shown and described, modifications may occur to those skilled in the art upon reading the specification. The present application includes such modifications and is limited only by the scope of the claims.

What is claimed is:

1. A durag comprising:

a center cap portion, wherein the center cap portion is configured to cover a head of a user, wherein the center cap portion includes a cap peripheral end portion;

only a single wrap, wherein the wrap has a fixed proximal end, a free distal end, and a longitudinal axis, wherein the fixed proximal end is attached to the cap peripheral end portion, wherein the wrap extends laterally in an unfolded state relative to the center cap portion such that the longitudinal axis of the wrap is configured to be transverse to the longitudinal axis of the user when the center cap portion is worn on the head of the user, wherein the wrap includes a first portion and a second portion, wherein the wrap is wrapped completely around the center cap portion at least three hundred sixty degrees and overlaps itself with the first portion detachably attached to the second portion and the free distal end overlapping the fixed proximal end and detachably attaching to the wrap via the first and second portions, wherein the wrap has a length that is more than one and a half times the circumference of the cap; and wherein the cap peripheral end defines an annular bottom of the center cap portion, wherein the wrap overlaps the entire annular bottom of the center cap portion when the wrap is wrapped around the center cap portion.

2. The durag of claim 1, wherein the first and second portions define a hook and pile fastener.

3. The durag of claim 1, further comprising a trim, wherein the trim defines a piece of fabric strip, wherein the trim includes a distal portion and a proximal portion, wherein the distal portion extends along a portion of the cap peripheral end portion, wherein the proximal portion is provided on the center cap portion and is located radially inwardly from the distal portion relative to the center cap portion, wherein the proximal portion and distal portion are radially separated at the center cap portion by a gap.

4. The durag of claim 3 wherein the proximal portion extends substantially around a center of the center cap portion.

5. The durag of claim 1, wherein the annular bottom is folded upwardly at a folding line and integrally joined with a longitudinal length of the wrap when the durag is worn on the head of the user.

6. The durag of claim 3, wherein the wrap includes opposite first and second longitudinal ends, wherein the trim further includes a third portion and a fourth portion, wherein the third portion extends along the first longitudinal end, wherein the fourth portion extends along the second longitudinal end, wherein the third portion and the proximal portion merge together, wherein the fourth portion and the distal portion merge together.

7. The durag of claim 6, wherein the annular bottom is folded upwardly at a folding line and integrally joined with a longitudinal length of the wrap when the durag is worn on the head of the user, wherein the fourth portion of the trim and the distal portion of the trim are located above the third portion of the trim and the proximal portion of the trim.

8. The durag of claim 6, further comprising an elastic band, wherein the elastic band extends along the cap peripheral end portion and is located between opposing portions of the trim.

9. The durag of claim 1, wherein the wrap has a length that is more than twice the circumference of the center cap portion.

10. The durag of claim 1, wherein the wrap includes a wrap peripheral end that merges with the cap peripheral end in the circumferential direction of the center cap portion to define a peripheral end of the durag.

11. The durag of claim 1, wherein the first and second portions define a hook and pile fastener, wherein the first portion includes a first lineal fabric strip comprising hooks adhered to a first side of the wrap, wherein the second portion includes a second lineal fabric strip comprising loops adhered to a second side of the wrap that is opposite the first side of the wrap, wherein the first and second lineal fabric strips are detachably attached to each other.

12. The durag of claim 1 further comprising:

a trim, wherein the trim defines a piece of fabric strip, wherein the trim includes a distal portion and a proximal portion, wherein the distal portion extends along a portion of the cap peripheral end portion, wherein the proximal portion is provided on the center cap portion and is located radially inwardly from the distal portion relative to the center cap portion, wherein the proximal portion and distal portion are radially separated at the center cap portion by a gap, wherein the proximal portion extends substantially around a center of the center cap portion, wherein the annular bottom is folded upwardly at a folding line and integrally joined with a longitudinal length of the wrap when the durag is worn on the head of the user, wherein the wrap includes opposite first and second longitudinal ends, wherein the trim further includes a third portion and a fourth portion, wherein the third portion extends along the first longitudinal end, wherein the fourth portion extends along the second longitudinal end, wherein the third portion and the proximal portion merge together, wherein the fourth portion and the distal portion merge together, wherein the fourth portion of the trim and the distal portion of the trim are located above the third portion of the trim and the proximal portion of the trim, wherein the wrap includes a wrap peripheral end that merges with the cap peripheral end in the circumferential direction of the center cap portion to define a peripheral end of the durag, wherein the first and second portions define a hook and pile fastener, wherein the first portion includes a first lineal fabric strip comprising hooks adhered to a first side of the wrap, wherein the second portion includes a second lineal fabric strip comprising loops adhered to a second side of the wrap that is opposite the first side of the wrap, wherein the first and second lineal fabric strips are detachably attached to each other; and an elastic band, wherein the elastic band extends along the cap peripheral end portion and is located between opposing portions of the trim.

13. A durag comprising:

a center cap portion, wherein the center cap portion is configured to cover a head of a user, wherein the center cap portion includes a cap peripheral end portion;

only a single wrap, wherein the wrap includes a wrap peripheral end portion that combines with the cap peripheral end portion in the circumferential direction of the center cap portion to define a peripheral end of the durag, wherein the wrap has a longitudinal axis, wherein the wrap extends laterally in an unfolded state relative to the center cap portion such that the longitudinal axis of the wrap is configured to be transverse to the longitudinal axis of the user when the center cap portion is worn on the head of the user, wherein the wrap includes opposite first and second free longitudinal ends, wherein the wrap has a fixed proximal lateral end and a free distal lateral end, wherein the fixed proximal lateral end is attached to the cap peripheral end portion, wherein the wrap is wrapped substantially around the center cap portion covering at least a front portion of the center cap portion and detachably attached to the peripheral end of the durag, wherein the wrap has a length that is more than the circumference of the center cap portion; and a trim, wherein the trim defines a piece of fabric strip, wherein the trim includes a distal portion and a proximal portion, wherein the distal portion extends along a portion of the cap peripheral end portion, wherein the proximal portion is provided on the center cap portion and is located radially inwardly from the distal portion relative to the center cap portion, wherein the proximal portion and distal portion are radially separated at the center cap portion by a gap.

14. The durag of claim 13, wherein the wrap is configured to be wrapped completely around the center cap portion at least three hundred sixty degrees with the free distal lateral end overlapping the fixed proximal lateral end.

15. The durag of claim 13, wherein the proximal portion extends substantially around a center of the center cap portion.

16. The durag of claim 13, wherein the cap peripheral end portion defines an annular bottom of the center cap portion, wherein the annular bottom is folded upwardly at a folding line and integrally joined with a longitudinal length of the wrap when the durag is worn on the head of the user.

17. The durag of claim 13, wherein the trim further includes a third portion and a fourth portion, wherein the third portion extends along the first free longitudinal end, wherein the fourth portion extends along the second free longitudinal end, wherein the third portion and the proximal portion merge together, wherein the fourth portion and the distal portion merge together.

18. A durag comprising:

a center cap portion, wherein the center cap portion is configured to cover a head of a user, wherein the center cap portion includes a cap peripheral end portion; and only a single wrap, wherein the wrap has a fixed proximal end, a free distal end, and a longitudinal axis, wherein the fixed proximal end is attached to the cap peripheral end portion, wherein the wrap extends laterally in an unfolded state relative to the center cap portion such that the longitudinal axis of the wrap is configured to be transverse to the longitudinal axis of the user when the center cap portion is worn on the head of the user, wherein the wrap includes a first portion and a second portion, wherein the wrap is wrapped completely around the center cap portion at least three hundred sixty degrees and overlaps itself with the first portion detachably attached to the second portion and the free distal end overlapping the fixed proximal end and detachably attaching to the wrap via the first and second portions, wherein the wrap has a length that is more than one and a half times the circumference of the cap, wherein the wrap is configured to be positioned above the eyes of a user such that the eyes are exposed when the durag is worn on the head of the user, wherein the cap peripheral end portion defines an annular bottom of the center cap portion, wherein the annular bottom is folded upwardly at a folding line and integrally joined with a longitudinal length of the wrap when the durag is worn on the head of the user.

19. The durag of claim 18, wherein the first and second portions define a hook and pile fastener.

20. The durag of claim 18 further comprising:

a trim, wherein the trim defines a piece of fabric strip, wherein the trim includes a distal portion and a proximal portion, wherein the distal portion extends along a portion of the cap peripheral end portion, wherein the proximal portion is provided on the center cap portion and is located radially inwardly from the distal portion relative to the center cap portion, wherein the proximal portion and distal portion are radially separated at the center cap portion by a gap, wherein the wrap includes opposite first and second longitudinal ends, wherein the trim further includes a third portion and a fourth portion, wherein the third portion extends along the first longitudinal end, wherein the fourth portion extends along the second longitudinal end, wherein the third portion and the proximal portion merge together, wherein the fourth portion and the distal portion merge together.

* * * * *